US008059058B2

(12) United States Patent
Lau et al.

(10) Patent No.: US 8,059,058 B2
(45) Date of Patent: Nov. 15, 2011

(54) ANTENNA SYSTEM AND METHOD FOR OPERATING AN ANTENNA SYSTEM

(75) Inventors: Buon Kiong Lau, Lund (SE); Joergen Bach Andersen, Gistrup (DK)

(73) Assignee: Sony Ericsson Mobile Communications AB (SE)

( * ) Notice: Subject to any disclaimer, the term of this patent is extended or adjusted under 35 U.S.C. 154(b) by 346 days.

(21) Appl. No.: 12/439,755

(22) PCT Filed: Sep. 5, 2007

(86) PCT No.: PCT/SE2007/000776

§ 371 (c)(1),
(2), (4) Date: Mar. 3, 2009

(87) PCT Pub. No.: WO2008/030165

PCT Pub. Date: Mar. 13, 2008

(65) Prior Publication Data

US 2010/0201598 A1 Aug. 12, 2010

Related U.S. Application Data

(60) Provisional application No. 60/842,238, filed on Sep. 5, 2006.

(30) Foreign Application Priority Data

Sep. 5, 2006 (SE) ..... 0601822

(51) Int. Cl.
*H01Q 1/50* (2006.01)

(52) U.S. Cl. ..... 343/861; 343/853; 343/860

(58) Field of Classification Search ..... 343/850, 343/853, 860, 861

See application file for complete search history.

(56) References Cited

U.S. PATENT DOCUMENTS

| | | | | |
|---|---|---|---|---|
| 5,778,308 | A | 7/1998 | Sroka et al. | |
| 2003/0210203 | A1 * | 11/2003 | Phillips et al. | 343/850 |
| 2005/0226353 | A1 | 10/2005 | Gebara et al. | |
| 2009/0079656 | A1 * | 3/2009 | Peyla et al. | 343/860 |

FOREIGN PATENT DOCUMENTS

| | | | |
|---|---|---|---|
| EP | 1 168 658 | A1 | 1/2002 |
| EP | 1 349 234 | A2 | 10/2003 |
| EP | 1 542 311 | A1 | 6/2005 |
| WO | WO 01/71846 | A1 | 9/2001 |

OTHER PUBLICATIONS

Supplementary European Search Report, EP 07 80 8795, May 12, 2010.

Pozar "Input Impedance and Mutual Coupling of Rectangular Microstrip Antennas" *IEEE Transactions on Antennas and Propagation*, AP-30(6):1991-1996 (1982).

Wallace et al. "Mutual Coupling in MIMO Wireless Systems: A Rigorous Network Theory Analysis", *IEEE Transactions on Wireless Communications* 3(4):1317-1325.

* cited by examiner

*Primary Examiner* — Tho G Phan

(74) *Attorney, Agent, or Firm* — Myers Bigel Slbley & Sajovec, P.A.

(57) ABSTRACT

An antenna system is disclosed that includes two or more antennas and an impedance matching network. The antennas of the antenna system are closely separated, such as by a distance of no more than a wavelength of received signals divided by two. The impedance matching network is adapted to respond to and counteract performance degradation resulting from cross coupling between the antennas. Related methods for use in an antenna system are disclosed.

8 Claims, 5 Drawing Sheets

ANTENNA SYSTEM AND METHOD FOR OPERATING AN ANTENNA SYSTEM

CROSS REFERENCE TO RELATED APPLICATIONS

This application is a 35 U.S.C. §371 national stage application of PCT Application No. PCT/SE2007/000776, filed on Sep. 5, 2007, which claims priority from Swedish Patent Application No. 0601882-0, filed Sep. 5, 2006 and U.S. Provisional Patent Application No. 60/842,238, filed Sep. 5, 2006, the disclosure and content of each of which are incorporated by reference herein in their entireties. The above-referenced PCT International Application was published in the English language as International Publication No. WO 2008/030165 on Mar. 13, 2008.

TECHNICAL FIELD

In general, the present invention relates to antenna systems. More particularly, the present invention relates to an antenna system comprising a plurality of antennas and an impedance matching network. The present invention also relates to a method for operating an antenna system having a plurality of antennas and an impedance matching network.

DESCRIPTION OF RELATED ART

In recent years, multiple antenna systems have been a subject of great interest in wireless communication systems. In general, they include: (i) the use of multiple antennas on one end of the system (either transmit or receive system), commonly known as smart antenna system or adaptive antenna system; (ii) the use of multiple antennas on both ends of the system, commonly known as multiple-input-multiple-output (MIMO) system. Prior art smart antenna systems can offer performance benefits. These include e.g. beamforming gain, diversity gain, and interference suppression, resulting in cell coverage extension and/or quality-of-service improvements. In addition to these benefits, MIMO systems can also offer the possibility of transmitting in parallel, non-interfering channels, with the maximum number of such channels limited by the number of transmit and receive antennas. As a consequence, the over-the-air data throughput can potentially increase linearly with number of antennas.

In the prior art, a necessary condition for obtaining multiple parallel channels for MIMO systems, and likewise diversity gain for smart antenna systems, is that the antennas should be placed sufficiently apart so that the received signals at different antennas are as dissimilar to one another as possible. In other words, a low correlation between the signals is needed. Typically, a separation of more than $\lambda/2$ is required, where $\lambda$ is the wavelength of the signals. Antennas at mobile base stations can therefore be sufficiently separated spatially. However, in small-sized mobile terminals, e.g. mobile telephones, the (largest) dimension of the terminal is typically less than or equal to $\lambda/2$. Therefore, this is not a feasible option for small-sized mobile terminals where the distance between the antennas may be less than or equal to $\lambda/2$. Apart from the problem with correlation, closely spaced antennas may strongly interact with one another electromagnetically. In turn, this may change the antenna characteristics, resulting in an increase in the impedance mismatch of the antennas and thus a reduction in the received power at the outputs of the antennas. In addition, the correlation between the signals is also affected by mutual coupling.

FIG. 1 illustrates a prior art single antenna system 10. The single antenna system 10 is operable to tune the input impedance of a single antenna 101 to that of a load circuit 102. This is performed by means of a matching network 103, which is ideally a lossless circuit. The matching network 103 may e.g. comprise either lumped or distributed elements connected between the antenna 101 and the load circuit 102. In the prior art, the tuning is performed only once and is fixed for a given antenna 101.

Adaptive impedance matching has recently become a subject of interest for mobile terminals. Such adaptive impedance matching relies on the matching network 103 to reduce the mismatch between the single antenna 101 and the load 102. The detection of mismatch is performed by varying the matching network 103 through all possible matching points and measuring the received power (in the case of a receiver) or the reflected power (in the case of a transmitter). The optimum matching network may correspond to the maximum received power (for receiver) or minimum reflected power (for transmitter). A main goal may be to reduce the mismatch loss resulting from nearby objects changing the antenna impedance.

In a multiple-antenna system having well separated antennas, the mutual coupling is in general negligible and single-antenna matching technique can be readily used. In other words, for such a system, the matching network can comprise separated or non-interconnected sub-networks, each matching an antenna to its load circuit, as in the single-antenna case illustrated in FIG. 1. In general, a matching network for an antenna system 20 with multiple antennas take the form of FIG. 2, where there are interconnections between the input ports P1, P2, . . . , PN and output ports connected to antennas A1, A2, . . . , AN. It is known from circuit theory that a multiple-port (or multiport) network (e.g., multiple antennas) can be perfectly matched (in respect of maximum power transfer between the multiport antennas and multiport load) by an extension to the complex conjugate match of single port (or antenna) network. In addition to almost zero impedance mismatch, the signals between the antennas are uncorrelated, as shown for an environment where the wireless signals arrive from all directions (3-D) in space with equal probability. This is, however, generally not the case with mobile communication environments where the wireless signals generally arrive nonuniformly from different directions. Moreover, the environment includes both near-field objects such as the user and far-field scatterers such as buildings and landscape. Hence, known antenna matching techniques fail to provide efficient matching in mobile communication environments for closely spaced multiple antennas.

There is consequently a need for providing improved performance of antenna systems, especially in those antenna systems where the antennas of a plurality of antennas are placed closely together.

SUMMARY OF THE INVENTION

Accordingly, the present invention preferably seeks to mitigate, alleviate or eliminate one or more of the above-identified deficiencies in the art and disadvantages singly or in any combination.

According to an aspect of the invention, there is provided an antenna system comprising a plurality of antennas and an impedance matching network, wherein the network is adaptive.

At least two of the antennas may be separated by a distance such that coupling exists. The at least two antennas may, e.g., be separated with a distance of less than or equal to $\lambda/2$, where λ is a wavelength of the signals. Furthermore, the network may be adaptive with regard to said coupling.

The impedance matching network may be adapted to counteract any performance degradation resulting from coupling among the plurality of antennas.

The antenna system may also comprise a means for channel measurement adapted to estimate at least one channel parameter from received signals, and a means for signal processing adapted to generate a control signal based on said at least one channel parameter and at least one predefined parameter of the antenna system. The impedance matching network may be controllable in dependence of said control signal. For example, the at least one channel parameter may be at least one statistical measure of the channel, such as an open-circuit correlation measure.

According to another aspect of the invention, there is provided a mobile terminal, e.g. a mobile telephone, which comprises the antenna system according to the embodiments of the invention.

According to yet another aspect of the invention, there is provided a method for operating an antenna system having a plurality of antennas and an impedance matching network, wherein the method comprises adaptive impedance matching performed by the network.

The antenna system may comprise at least two antennas, which are separated by a distance such that coupling exists. The distance may, e.g., be less than or equal to λ/2, where λ is a wavelength of the signals. The method may comprise adaptation of the impedance matching network taking into consideration said coupling.

Additionally, or alternatively, the method may comprise counteracting any performance degradation resulting from coupling among the plurality of antennas.

Furthermore, the method may comprise estimating at least one channel parameter from received signals, generating a control signal based on said at least one channel parameter and at least one predefined parameter of the antenna system, and controlling the network in dependence of said control signal. For example, the at least one channel parameter may be at least one statistical measure of the channel, such as an open-circuit correlation measure.

According to still another aspect of the invention, there is provided a computer program product comprising program instructions for causing a computer system to perform the method according to the embodiments of the invention when the program instructions are run on a computer system having computer capabilities. The computer program product may e.g. be embodied on a record medium; stored in a computer memory, embodied in a read-only memory, or carried on an electrical carrier signal.

Further embodiments of the invention are defined in the dependent claims.

DETAILED DESCRIPTION OF EMBODIMENTS

Figure 1:
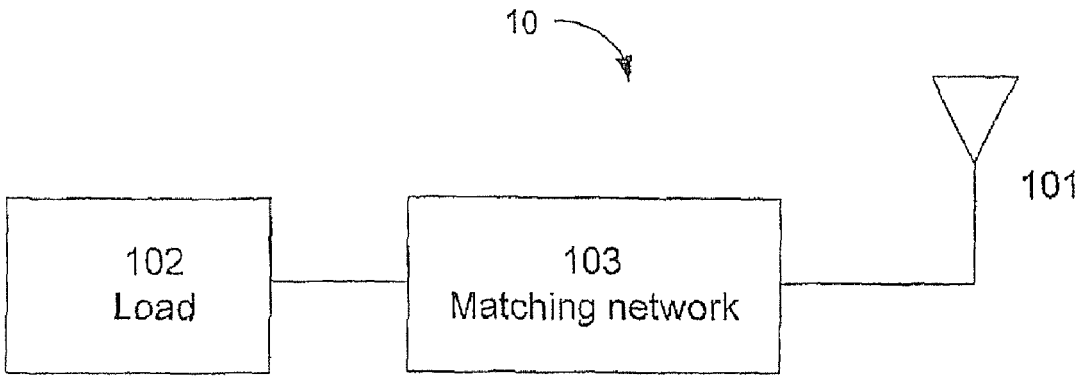
FIG. 1 (Prior Art)
FIG. 1 is a block diagram of a prior art antenna system with a single antenna.
Figure 2:
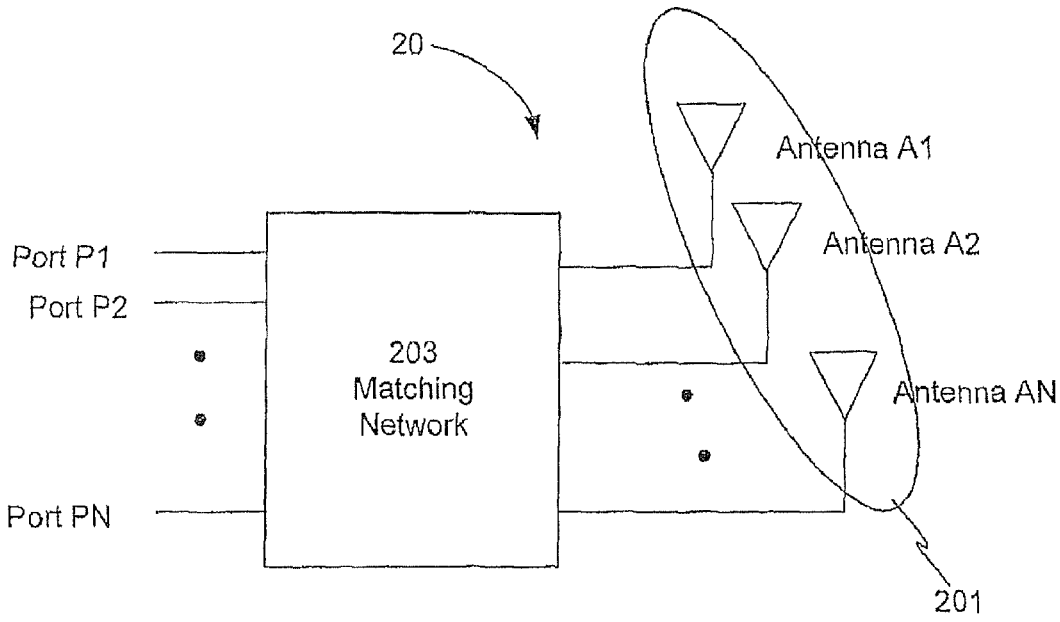
FIG. 2 (Prior Art)
FIG. 2 is a block diagram of a prior art antenna system with multiple antennas.

The embodiments described hereinbelow disclose the best mode and enables a person ordinary skilled in the art to carry out the present invention. The different features of the embodiments can be combined in other manners than described below. The invention may be embodied in many different forms and should not be construed as limited to the embodiments set forth herein. Rather, these embodiments are provided so that this disclosure will be thorough and complete, and will fully convey the scope of the invention to those skilled in the art. The invention is only limited by the appended patent claims.

An embodiment of the antenna system will be described below. The antenna system generally comprises a plurality of antennas and an impedance matching network. The impedance matching network is adaptive.

The antenna system comprises two or more antennas, wherein the two or more antennas are separated by a distance (in relation to each other) such that coupling exists. The antennas may e.g. be separated by a distance, which is less than or equal to λ/2. The adaptive impedance matching network may be adaptive with regard to said coupling. For example, the adaptive impedance matching network may be adapted to counteract any performance degradation resulting from coupling (e.g. electromagnetic or mutual coupling) among the plurality of antennas.

The antenna system may comprise a means for channel measurement adapted to estimate at least one channel parameter from received signals, and a means for signal processing adapted to generate a control signal based on said at least one channel parameter and at least one predefined parameter of the antenna system. The adaptive impedance matching network may be controllable in dependence of said control signal.

For example, the adaptive impedance matching network can be used for optimizing the performance of an antenna system having multiple antennas, in particular, in response to changes in the environment, taking into account of coupling (e.g. electromagnetic or mutual coupling) among the antennas of the plurality of antennas.

An adaptive impedance matching network according to embodiments of the invention can be used to improve the performance of antenna systems having multiple antennas in wireless communications, especially in those antenna systems where the antennas of the plurality of antennas are placed closely together and wherein mutual coupling exists among the antennas.

The antenna system according to embodiments of the invention may advantageously be used in compact systems, such as e.g. mobile terminals, in which the inclusion of multiple antennas generally imply strong electromagnetic (or mutual) coupling among the antennas, which by itself result in severe performance degradations, regardless of the environment.

In particular, the antenna system according to embodiments of the invention may utilize a multiple-port adaptive impedance matching network to counteract the performance degradation resulting from mutual coupling and/or changes in the environment as seen by the antennas. In addition to impedance mismatch, which also exists in the single antenna system, the performance of multiple antenna system is also dependent on the correlation between the received signals.

Therefore, the application of adaptive matching for multiple antennas is not a simple extension to the single antenna case.

Figure 3:
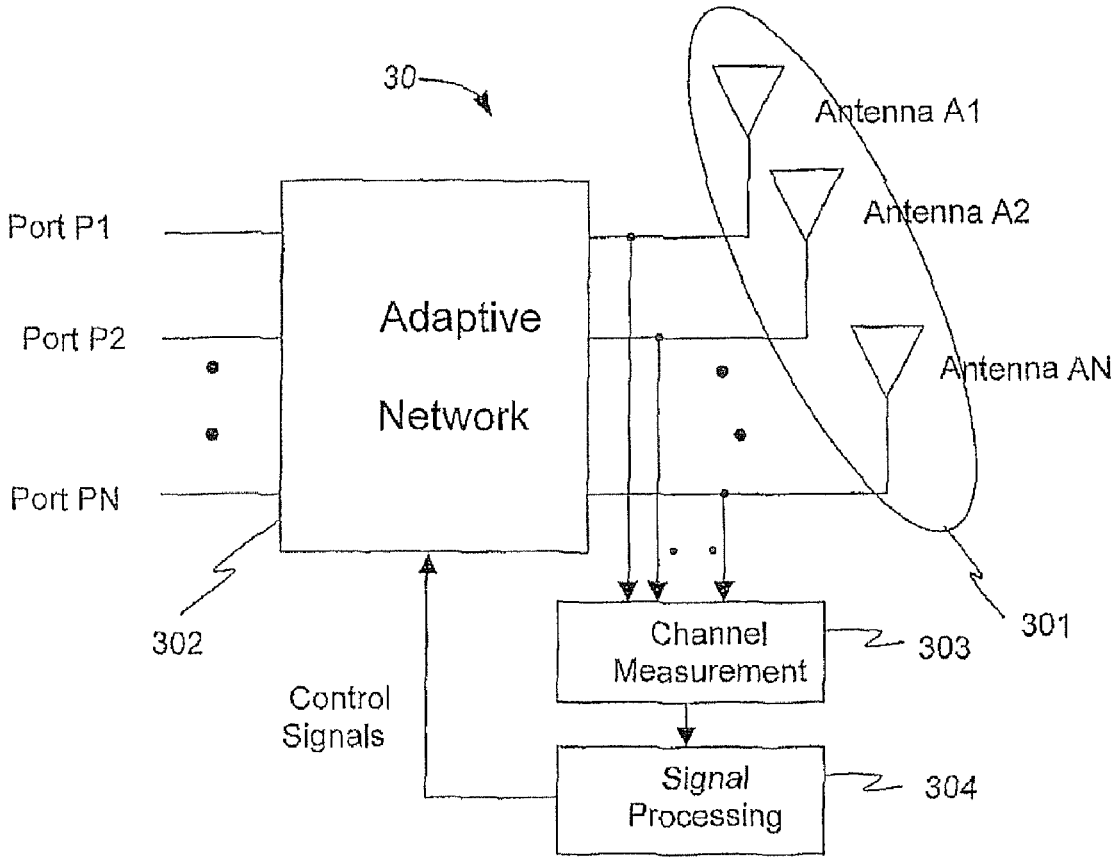
FIG. 3 is a block diagram of an embodiment of an antenna system having multiple antennas and an impedance matching network.

FIG. 3 illustrates an embodiment of an antenna system 30 comprising a plurality of antennas 301 and an impedance matching network 302. The impedance matching network 302 is adaptive. The radio-frequency (RF) signals propagate from transmit antennas of a transmitter (not shown) to the set 301 of receive antennas A1, A2, . . . , AN, via multiple propagation paths, due to the existence of scattering objects (e.g., cars, buildings, road signs) in the environment. The transfer function between a transmit antenna and a receive antenna A1, A2, . . . , AN is a function of these signal paths, each with distinct parameters such as path length (or delay), direction of departure and arrival, and Doppler frequency. The overall transfer function is a summation over all paths for all possible pairs of transmit and receive antennas is known as the MIMO channel matrix H. A means 303 for channel measurement, such as a channel measurement unit is adapted to extract or estimate the matrix H from the received signals. This operation can be performed at a regular interval, for example, using training signals. A means 304 for signal processing, such as e.g. a signal processing unit is adapted to generate an optimum multiport matching network with respect to a performance metric over operating frequency band(s) of interest, based on the estimated H and known characteristics of the receive antennas (e.g. characteristics with respect to self impedance and mutual impedance). The performance metric may e.g. be received power, correlation, and/or capacity. The predicted optimum matching network may then be realized in the adaptive matching network 302 by applying control signals from the signal processing unit 304. The measurement or estimation of the matrix H may be aided by control signals, which temporarily disconnect all antennas 301 by open-circuits (e.g., in the adaptive matching network 304) except the antenna for which transfer function is being measured.

According to an embodiment, an instantaneous estimate of H may be used for adaptation. Alternatively, or additionally, the statistics of H (e.g., correlation between the different received signals) may also be used. The statistics may be calculated from estimates of H obtained over multiple channel measurement instances over a time interval where the statistics of the environment is considered stable. In a slowly changing environment, such adaptive matching based on channel statistics, i.e. an average behavior, has the benefits of reducing the computational efforts involved in the adaptation procedure, e.g. because less information is required and it is less frequently performed. It may also offer a more robust performance due to reduced sensitivity to estimation errors.

According to another embodiment, in the following referred to as a full implementation of the antenna system 30, the adaptive matching network 302 is arranged to realize any N by N impedance matrix, as seen from the antenna ports.

According to other embodiments, a simplified adaptive matching network 302, having restrictions imposed on the realizable impedance matrices, may be utilized. For example, the matching network may be uncoupled, i.e. the adaptive matching network 304 comprises a separate matching network for each antenna Aj arranged to be connected between said antenna Aj and the corresponding port Pj, without any interconnection between said separate matching networks.

Further reduction of complexity may be obtained. For example, the channel measurement unit 303 may be adapted to limit the channel estimation to only generate the open-circuit correlation, which is a statistical measure of the channel. Based on the open circuit correlation, the performance metric can be evaluated as function of matching impedance.

Further, if the matching network is uncoupled, i.e. there is no interconnection between the matching circuits connecting each antenna with its load, the optimization may be performed by a two-dimensional grid search within the signal processing unit 30, over the range of matching impedance afforded by the particular circuit realization of the adaptive matching network. An optimized solution is then realized in the adaptive matching network 304 by appropriate control signals. Known circuit realizations, which were originally intended for single antenna adaptive matching, can be used to implement the separate matching networks, connected to each antenna A1, A2, . . . , AN, of the adaptive matching network 10.

Figure 4:
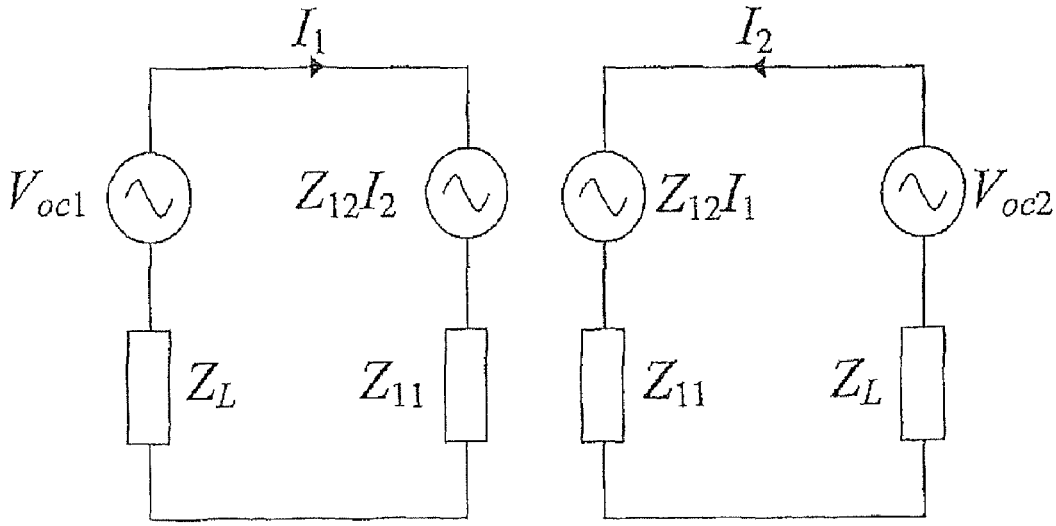
FIG. 4 is a block diagram of a circuit model of two receive antennas, each with an equivalent load ZL, wherein the load ZL represents the equivalent load (matching network+load in cascade) as seen by the antennas.

As an illustration of benefits of the adaptive matching system, a simple MIMO system with two transmit and two receive antennas is considered in the following. As an example, all antennas are identical half-wavelength (or $\lambda/2$) electric dipoles. The downlink transmission is considered, where the transmit antennas at the mobile base station are assumed to be far apart and thus uncorrelated. The receive antennas are placed compactly on or within a mobile terminal, e.g. with the spacing between them at $0.05\lambda$. The self and mutual impedances of the receive dipole antennas are respectively $Z_{11}=92.7+j39.4\Omega$ and $Z_{12}=91.1+j17.87\Omega$. The impedance matching network is represented by an impedance load $Z_L$ connected to each antenna. The environment is represented as voltages $V_{oc1}$ and $V_{oc2}$, which are voltages across the respective antenna ports when they are open-circuited. The circuit model for the receive antennas is given in FIG. 4.

The channel matrix for the well known Kronecker model can be formed as follows:

$$H=\Psi_R^{1/2}H_{iid}, \tag{1}$$

where $$\Psi_R=\begin{bmatrix}1 & \alpha\\ \alpha^* & 1\end{bmatrix}$$

is the receive correlation matrix, $\alpha$ the open circuit correlation at the receive antennas, * denotes the complex-conjugate operator and the elements of the matrix $H_{iid}$ are complex Gaussian random variables with zero mean and average power of 1. The open circuit correlation is obtained from open-circuit voltages, i.e.

$$\alpha=E(V_{oc1}V_{oc2}^*)/\sqrt{E(|V_{oc1}|^2)E(|V_{oc2}|^2)}, \tag{2}$$

The instantaneous capacity of the 2×2 MIMO system for equal transmit power at the transmitter can be derived as:

$$C=\log_2\det\left(I+2\gamma_{ref}\mathrm{Re}(Z_{11})\mathrm{Re}(Z_L)Z^{-1}H(Z^{-1}H)^H\right)\text{ where} \tag{3}$$

$$Z=\left(Z_L I+\begin{bmatrix}Z_{11} & Z_{12}\\ Z_{12} & Z_{11}\end{bmatrix}\right)$$

I is the 2×2 identity matrix, $(\bullet)^H$ the Hermitian-transpose operator, $\gamma_{ref}=20$ dB the reference SNR. The channel matrix is normalized against the average received power a single antenna system with conjugate impedance match at both the transmit and receive antennas.

The Laplacian distribution is assumed for the propagation environment:

$$p(\phi)=c_1\exp[-\sqrt{2}|\phi-\phi_0|/\sigma]/\sqrt{2}\sigma, \tag{4}$$

where $\phi_0$=90° (endfire direction) and $\sigma$=15° are respectively the mean and the standard deviation of the distribution, $c_1$ is a normalization factor such that the integral of $p(\phi)$ over the azimuth plane is 1.

In order for the adaptive matching system to function, the open-circuit correlation is first calculated from open-circuit voltages of the antennas using Equation (2) in the channel measurement unit 303. In this example, $\alpha$=0.96−j0.27. The value is then passed on to the signal processing unit 304, where the performance metric, in this case, mean or ergodic capacity is generated based on matching load impedance $Z_L$. The mean capacity may be conveniently obtained from the instantaneous capacity of Equation (3) using e.g. an approximate closed form expression in the paper by G. Alfano, A. M. Tulino, A. Iozano, and S. Verdu, "Capacity of MIMO channels with one-sided correlation," in *Proc. ISSSTA*, vol. 1, pp. 515-519, Sydney, Australia, 30 August-2 September 30204. A two-dimensional grid search over the load impedance plane of load resistance and reactance may then be performed to find the maximum mean capacity. The contour plot of mean capacity over the load impedance plane is given in FIG. 5. The optimum matching load corresponding to maximum mean capacity (7.4 bits/s/Hz) in this case is 2−j22Ω. This matching point is then relayed to the adaptive matching network through control signals, which realize this matching condition.

Figure 5:
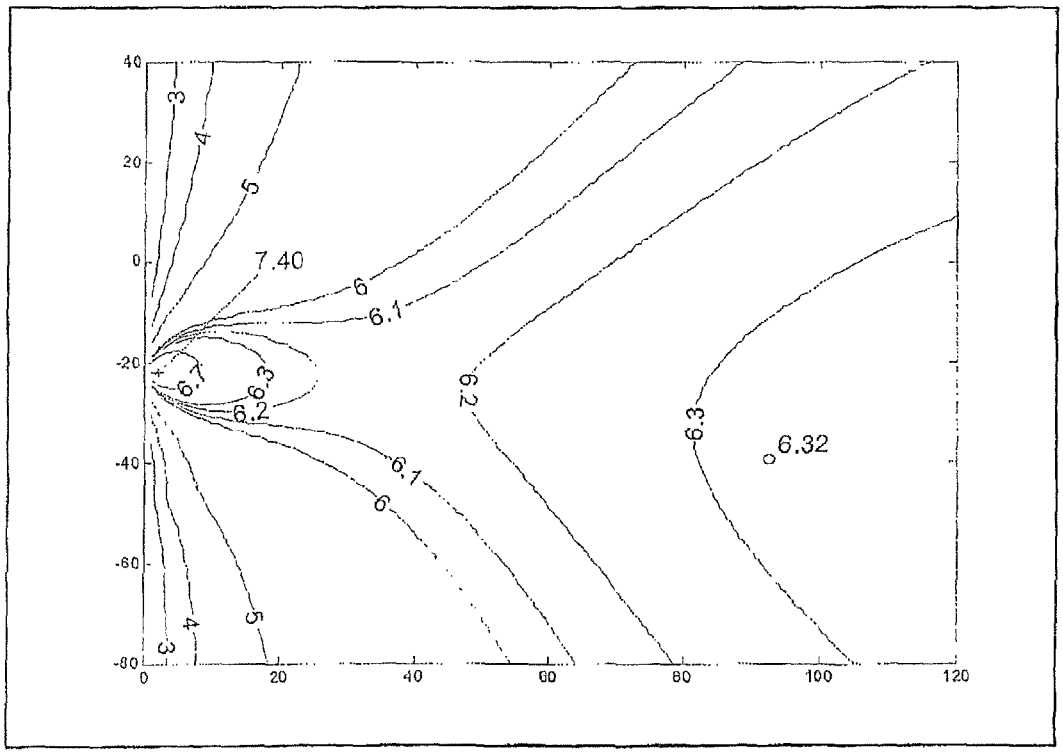
FIG. 5 is a contour plot of the mean capacity variation (in units of bits/s/Hz) with load impedance matching with $R_L$ and $X_L$ (in units of ohm).

As a comparison, this optimized mean capacity is compared with the capacity obtained from implementing a complex conjugate match on only the self-impedance of the antenna ($Z_L$=$Z_{11}$*), also known as self-impedance matching. As indicated in FIG. 5, the optimum capacity (point marked by *) is 7.4 bits/s/Hz, as opposed to that of the self-impedance match (point marked by o) of 6.32 bits/s/Hz. This indicates a capacity gain of over 1 bits/s/Hz from the proposed adaptive technique. Another figure of merit can be given by the extra signal power needed for the self-impedance match to attain the capacity 7.4 bits/s/Hz. This is obtained by increasing the reference SNR $\gamma_{ref}$ until the capacity for the self-impedance match is equal to 7.4 bits/s/Hz. In this example, it is found that >3 dB of additional power is required, which translates to an equivalent of 3 dB gain in signal strength through the adaptation. Even higher gains can be expected from the full implementation, discussed above, that utilizes a generalized adaptive matching network.

The adaptive matching network that is used in the embodiments described above in the context of a receiver may also be used to improve transmit signals if a compact multiple antenna system (e.g., a mobile terminal such as a mobile telephone) shares the same transmit and receive frequency (and antennas), as in the case of time-division duplex (TDD) systems. This is because the propagation channels as seen by the transmit antennas are the same as those by the collocated receive antennas.

Some embodiments of the invention provide for improved performance of antenna systems comprising a plurality of antennas. In particular, some embodiments of the invention allow for improved performance of antenna systems where the antennas of a plurality of antennas are placed closely together and wherein strong electromagnetic or mutual coupling may exist among the antennas.

It is an advantage with some embodiments of the invention that they can be used in compact systems, e.g. in mobile terminals such as mobile telephones. Since there is a trend towards more compact mobile terminals in the future, some embodiments of the present invention may be advantageously utilized in prospective compact mobile terminals.

Applications and use of the above-described embodiments according to the invention are various and include all fields wherein an antenna system with multiple antenna is used, and especially in those antenna systems where the antennas of a plurality of antennas are placed closely in relation to each other.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "optimize/optimizing" is used to mean achieve/achieving an improved performance or result in some respect. Accordingly, the term "optimum" is used to mean an improved performance or improved result in some respect. Optimizing may mean optimizing in respect of e.g. received power, correlation, capacity, BER (Bit Error Rate), FER (Frame Error Rate), et cetera.

As used herein, the singular forms "a", "an" and "the" are intended to comprise the plural forms as well, unless expressly stated otherwise. It will be further understood that the terms "includes/including" and/or "comprises/comprising" when used in this specification, is taken to specify the presence of stated features, integers, steps, operations, elements, and/or components, but do not preclude the presence or addition of one or more other features, integers, steps, operations, elements, components, and/or groups thereof.

The present invention has been described above with reference to specific embodiments. However, other embodiments than the above described are equally possible within the scope of the invention. Combinations and modifications of the above-mentioned embodiments should be able to be implemented by a person ordinary skilled in the art to which this invention belongs. The different features of the invention may be combined in other combinations than those described. The different embodiments described above do not limit the scope of the invention, but the scope of the invention is only limited by the appended patent claims.

The invention claimed is:

1. An antenna system for a multiple-input-multiple-output (MIMO) system, the antenna system comprising:

a plurality of antennas, wherein at least two of the antennas are separated by a distance at which coupling exists therebetween;

a channel measurement circuit adapted to estimate at least one channel parameter of correlation between signals received by the at least two of the antennas; and a signal processing circuit adapted to generate a control signal in response to the at least one channel parameter estimated by the channel measurement circuit and at least one predefined parameter of the antenna system; and an impedance matching network that interconnects the antennas to a load, wherein the impedance matching network is adapted to control impedance between the antennas and the load responsive to the control signal.

2. The antenna system according to claim 1, wherein the at least two antennas are separated with a distance of less than or equal to $\lambda/2$, where $\lambda$ is a wavelength of signals that the at least two antennas are configured to receive.

3. The antenna system according to claim 1, wherein the impedance matching network is further adapted to control impedance between the antennas and the load to counteract performance degradation of the at least two of the antennas because of the coupling between the at least two of the antennas.

4. The antenna system according to claim 1, wherein the at least one channel parameter estimated by the signal processing circuit is an open-circuit correlation measurement.

5. A mobile telephone comprising the antenna system of claim 1.

6. A method for operating an antenna system for a multiple-input-multiple-output (MIMO) system, the antenna system having a plurality of antennas and an impedance matching network that interconnects the antennas to a load, wherein at least two of the antennas are separated by a distance at which coupling exists therebetween, the method comprising:

estimating at least one channel parameter of correlation between signals received by the at least two of the antennas; and generating a control signal in response to the estimated at least one channel parameter and at least one predefined parameter of the antenna system; and controlling impedance between the antennas and the load responsive to the control signal.

7. The method of claim 6, regulating the control signal to control impedance between the antennas and the load to counteract performance degradation of the at least two of the antennas because of the coupling between the at least two of the antennas.

8. The method of claim 6, wherein the estimated at least one channel parameter estimated is an open-circuit correlation measurement.

* * * * *